US008079676B2

(12) United States Patent
Elrod

(10) Patent No.: US 8,079,676 B2
(45) Date of Patent: Dec. 20, 2011

(54) SYSTEM AND METHOD FOR ACOUSTIC EJECTION OF DROPS FROM A THIN LAYER OF FLUID

(75) Inventor: Scott A. Elrod, La Honda, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 338 days.

(21) Appl. No.: 12/336,038

(22) Filed: Dec. 16, 2008

(65) Prior Publication Data

US 2010/0149263 A1 Jun. 17, 2010

(51) Int. Cl.
*B41J 2/045* (2006.01)

(52) U.S. Cl. ..... 347/68

(58) Field of Classification Search ..... 347/68, 347/69, 70–72, 46, 56, 61
See application file for complete search history.

(56) References Cited

U.S. PATENT DOCUMENTS

| | | | | |
|---|---|---|---|---|
| 4,719,476 | A | 1/1988 | Elrod et al. | |
| 5,194,880 | A | 3/1993 | Elrod et al. | |
| 6,328,421 | B1 * | 12/2001 | Kojima et al. | 347/46 |
| 6,416,678 | B1 | 7/2002 | Hadimioglu et al. | |
| 6,464,337 | B2 | 10/2002 | Roy et al. | |
| 6,467,877 | B2 * | 10/2002 | Ellson | 347/46 |
| 6,494,565 | B1 | 12/2002 | Ellson et al. | |
| 6,511,162 | B1 * | 1/2003 | Kashino et al. | 347/71 |
| 6,644,785 | B2 | 11/2003 | Elrod et al. | |
| 2002/0073990 | A1 | 6/2002 | Noolandi et al. | |
| 2002/0077369 | A1 | 6/2002 | Noolandi et al. | |

* cited by examiner

*Primary Examiner* — Kristal Feggins
(74) *Attorney, Agent, or Firm* — Fay Sharpe LLP

(57) ABSTRACT

Features described herein relate to ejecting drops from a thin layer of fluid. Piezoelectric elements can generate a uniform high acoustic field, which is transferred through a segmented metal support structure and an acoustic horn. The sound waves generate capillary waves on a thin layer of fluid on a top surface of the acoustic horn. At sufficiently high amplitudes, the capillary waves begin to break apart, resulting in the ejection of drops from the thin layer of fluid.

20 Claims, 3 Drawing Sheets

SYSTEM AND METHOD FOR ACOUSTIC EJECTION OF DROPS FROM A THIN LAYER OF FLUID

BACKGROUND

The subject application relates to drop ejection, and in particular to pattern ejection of a mist of very small droplets from capillary waves.

An example of a drop ejector which operates to eject droplets by controlling capillary wave action is set forth in U.S. Pat. No. 5,194,880, titled, "Multi-Electrode, Focused Capillary Wave Energy Generator", to Elrod et al., issued Mar. 16, 1993, which discloses a capillary wave printer that can generate a ripple wave at the top of a fluid container. An electroacoustic transducer positioned at the bottom of a fluid container generates a ripple wave, and the wave propagates through the fluid reservoir, resulting in a disturbance of the fluid reservoir. Consequently, the top of the fluid reservoir can begin to emit droplets of fluid due to the vibrations imparted by the piezoelectric pushers.

However, Elrod et al. is directed to the formation of complex high resolution images and requires employing costly complex switching and imaging electronics and sophisticated operations to control the capillary waves for individual drop ejection and placement. Thus, such devices do not lend themselves to industrial uses which would have need for ejectors able to generate simple patterns by use of a low cost printhead design, which permit for simplified control operations.

BRIEF DESCRIPTION

In accordance with one aspect of the present exemplary embodiment, an apparatus for ejecting drops comprises a segmented metal support structure comprising a first side and a second side with a plurality of extending metal elements; piezoelectric elements in operative connection to at least some of the extending metal elements of the segmented metal support structure on the first side; and an acoustic horn in operative connection to the second side of the segmented metal support structure, a thickness of the acoustic horn decreases as distance increases from the second side of the segmented metal support structure, the acoustic horn configured to resonate from energy emitted from the piezoelectric elements and transferred through the segmented metal support structure.

DETAILED DESCRIPTION

The subject application relates to ejecting drops from a thin layer of fluid. An apparatus comprises a segmented metal support structure, in which drops are ejected in areas of the thin layer of fluid that are above extending metal elements of the segmented metal support structure. The areas of the thin layer of fluid that are not above extending metal elements experience less agitation than areas of the thin layer of fluid that are above the extending metal elements.

Figure 1:
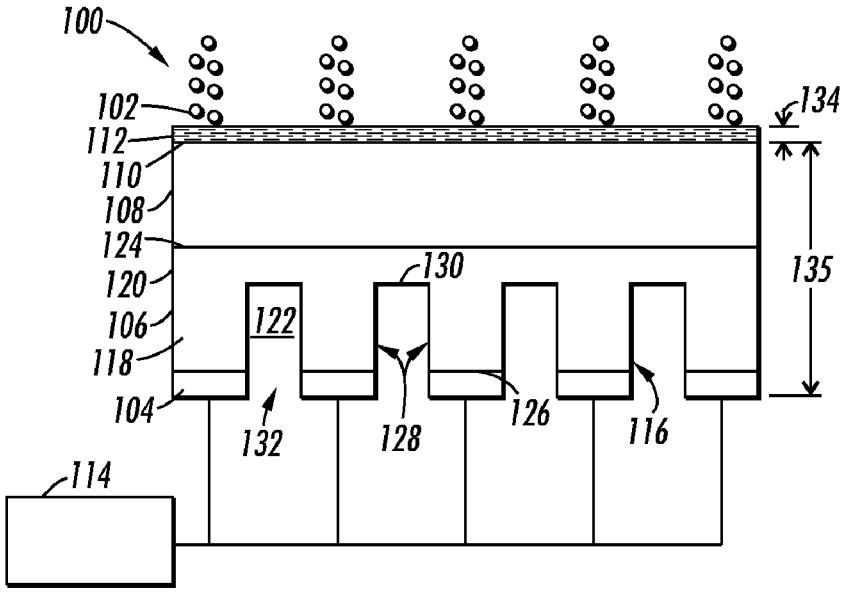
FIG. 1 is an apparatus for ejecting drops with a solid acoustic horn.

Referring to FIG. 1, an apparatus 100 such as a drop ejector for ejecting and depositing thin uniform films of liquid drops 102 in a predetermined pattern is shown. The apparatus 100 comprises sound wave generating devices 104, such as but not limited to, piezoelectric elements 104 in operative connection with a support structure 106, which in this embodiment is a partially segmented support structure. The support structure may be made of metal or other material which provides a path for generated sound waves. A tapered acoustic horn 108 is also in operative connection with the partially segmented support structure 106, and on a top surface 110 of the tapered acoustic horn 108 is a thin layer of fluid 112.

The piezoelectric elements 104 may be connected to a suitable power supply controller arrangement 114 to selectively provide power. Piezoelectric elements 104 are in operative connection with a first side/surface 116 of the partially segmented support structure 106.

The partially segmented support structure 106 comprises extending elements 118 and a unifying section 120. The partial segmentation results in spaces 122 between the extending elements 118. The unifying section 120 joins the extending elements 118 and provides the partially segmented support structure 106 with a second side/surface 124.

Each extending element 118 comprises a horizontally planar surface 126 at a perpendicular angle with vertically planar surfaces 128. The unifying section 120 also forms a perpendicular angle with the vertically planar surfaces 128. Two of the extending elements 118 and a portion of the unifying section 120 form a space or open area 122. Each space or open area 122 is defined by two of the vertically planar surfaces 128 and the portion of the unifying section 120, defined as an upper horizontal planar surface 130, opposite an opening 132. It is also noted the depth or length of unifying section 120 is defined by second side/surface 124 and upper horizontal planar surfaces 128.

The second side/surface 124 of the partially segmented support structure 106 is also operatively connected to the tapered acoustic horn 108. The shape of the tapered acoustic horn 108, described in more detail with reference to FIG. 3, narrows from the point of operative connection to the partially segmented support structure 106 to the top surface 110 of the tapered acoustic horn 108. The tapered acoustic horn 108 can be made of brass, or any other suitable material. At the top surface 110 of the tapered acoustic horn 108 is the thin layer of fluid 112.

In one embodiment, fluid continuously flows over the top surface 110 of the tapered acoustic horn 108 to create the thin layer of fluid 112. Alternatively, the fluid can be pooled on the top surface 110. If the fluid continuously flows over the tapered acoustic horn 108, the fluid may flow from a nearby opening (not shown), allowing a calculated amount of fluid to flow over the top surface 110 at any given time.

Furthermore, the thin layer of fluid 112 can take a variety of forms and dimensions. For example, thin layer of fluid 112 can comprise catalyst particles and/or conductor particles. The dimensions of the thin layer of fluid 112 can vary, but a height 134 of the thin layer of fluid 112, when undisturbed, is generally less than the spacing 122 between the extending elements 118 of the partially segmented support structure 106. For example, the height 134 of the thin layer of fluid 112 may be approximately 1 mm when no sound waves are resonating through the tapered acoustic horn 108.

Figure 4:
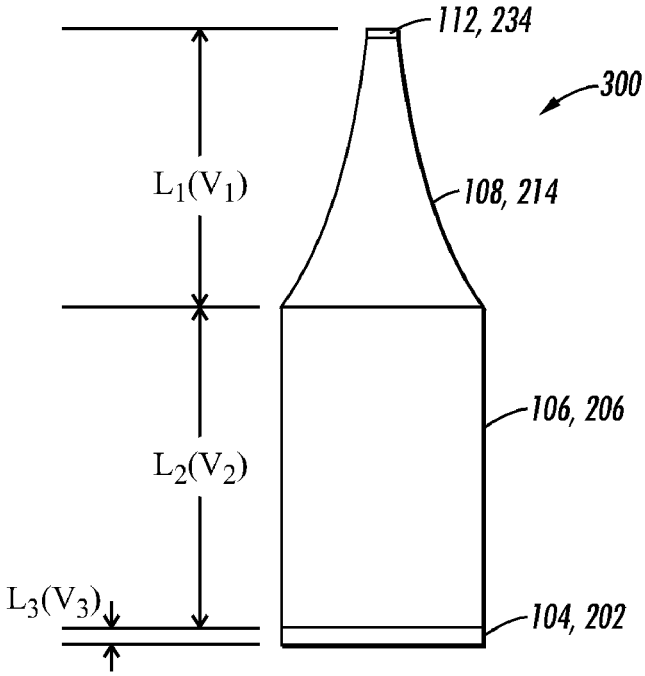
FIG. 4 shows a side view representative of any of the apparatuses of FIGS. 1-3.

The sound waves generated from the piezoelectric elements 104 propagate through the partially segmented support structure 106 and cause vibrations in the tapered acoustic horn 108. The wavelength of the sound waves is selected in relationship with the piezoelectric elements 104, partially segmented support structure 106, and the tapered acoustic horn 108. Such relationship is illustrated in FIG. 4, and is generally defined as:

$$\frac{1}{2f} = \frac{L_1}{V_1} + \frac{L_2}{V_2} + \frac{L_3}{V_3}, \qquad \text{[Equation 1]}$$

where $L_1$ is the length of the acoustic horn, $L_2$ is the length of the support structure, $L_3$ is the length of the piezoelectric elements, $V_1$ is the speed at which sound travels through the material (i.e., its acoustic impedance) of the acoustic horn, $V_2$ is the speed at which sound travels through the material (i.e., its acoustic impedance) of the support structure and $V_3$ is the speed at which sound travels through the piezoelectric elements (i.e., its acoustic impedance) and f is frequency of the sound waves.

For desirable results, the materials for the three components (i.e., piezoelectric elements, support structure and the acoustic horn) should be roughly matched in acoustic impedance. In one example brass and PZT provide a useful impedance match.

The shape of the tapered acoustic horn 108 focuses the sound waves to provide maximum transfer of energy to the thin layer of fluid 112 on the top surface 110 of the tapered acoustic horn 108. As the sound waves travel through the tapered acoustic horn 108, the sound waves continue to travel primarily in areas of the tapered acoustic horn 108 that are above the extending elements 118 of the partially segmented support structure 106. The intensity of sound waves is greatest in areas of the tapered acoustic horn 108 that are above extending elements 118.

The thin layer of fluid 112 above the top surface 110 of the tapered acoustic horn 108 is disrupted from sound waves traveling through the tapered acoustic horn 108. As a result of the disruptions, capillary waves form on the surface of the thin layer of fluid 112. The capillary waves vary in intensity, and are most intense in areas of the thin layer of fluid 112 above the extending elements 118 of the partially segmented support structure 106. As the capillary waves reach sufficiently high amplitudes, the capillary waves begin to break apart and generate the droplets 102.

The power supply 114 is controlled to have the piezoelectric elements 104 generate a uniform high acoustic field, which causes sound waves to travel through the partially segmented support structure 106. On the other hand, spaces 122, act to diminish sound wave propagation to the thin layer of fluid 112. Particularly, the open area of the spaces dissipates any sound waves which may extend in the spaces 122. Thus, in areas of the thin layer of fluid 112 that are not above extending elements 118 of the partially segmented support structure 106 are not disturbed, and droplets are not ejected from areas of the thin layer of fluid 112 that are not above extending elements 118 of the partially segmented support structure 106.

Since the capillary waves are most intense in areas above the extending elements 118, the droplets 102 are ejected from areas of the thin layer of fluid 112 that are above the extending elements 118, resulting in a pattern being formed on an article or substrate positioned to receive the droplets 102. This is due to the partially segmented support structure 106 primarily directing sound waves to areas of the thin layer of fluid 112 that are above the extending elements 118.

Figure 2:
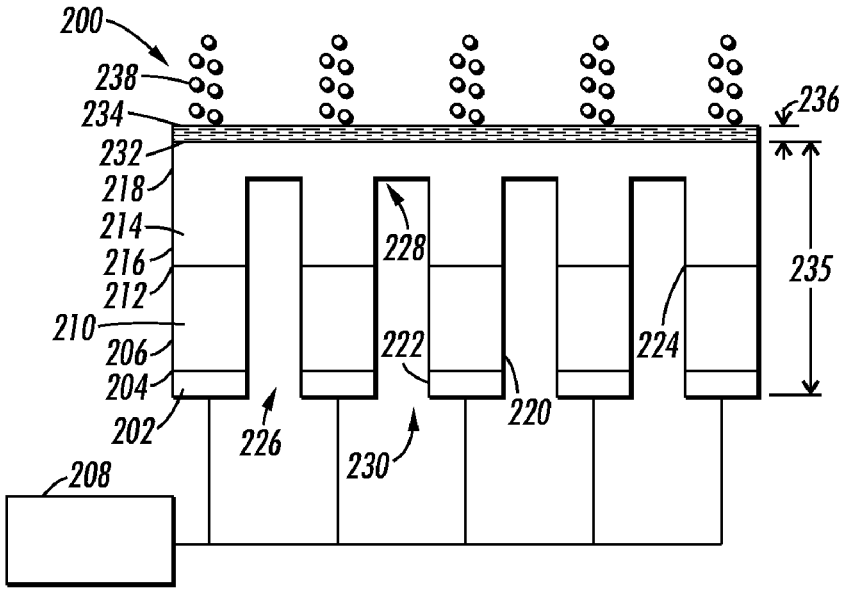
FIG. 2 is an apparatus for ejecting drops with a partially segmented acoustic horn.

Referring to FIG. 2, another example of a drop ejecting apparatus 200 is shown. Piezoelectric elements 202 are attached to a first surface 204 of a fully segmented support structure 206, and are in operative connection to a power supply 208. The fully segmented support structure 206 comprises independent elements 210, which are separate from one another and not joined by a unifying section (e.g., unifying section 140 of FIG. 1). The fully segmented support structure 206 has a second surface 212, which is operatively connected to a partially segmented tapered acoustic horn 214.

The partially segmented tapered acoustic horn 214 comprises acoustic horn extending elements 216 joined at an upper end by a unifying section 218. Each independent element 210 is in operative connection to a corresponding acoustic horn extending element 216. Two vertically oppositely positioned planar surfaces 220 define sides of each independent element 210, and the vertically planar surfaces 220 meet horizontally planar surfaces 222 and 224 at substantially perpendicular angles. The vertically planar surfaces 220 and horizontally planar surface 224 meet the partially segmented acoustic horn 214 at extending elements 216. Each acoustic horn extending element 216 aligns with a corresponding independent element 210, creating a smooth vertical surface. Spaces or open areas 226 are further defined in this embodiment to include the areas between surfaces of opposing acoustic horn extending elements 216, and an upper horizontal planar surface 228 which is opposite an opening 230.

The partial segmentation of the partially segmented tapered acoustic horn 214 acts to control the propagation of sound waves through the partially segmented tapered acoustic horn 214. The partial segmentation reduces the area in which sound waves can efficiently propagate through in the unifying section 218 of the segmented tapered acoustic horn 214, that are not above the acoustic horn extending elements 216. Sound wave intensity is increased in areas of the unifying section 218 of the segmented tapered acoustic horn 214 that are above the acoustic horn extending elements 216.

The unifying section 218 joins the acoustic horn extending elements 216 and provides the partially segmented tapered acoustic horn 214 with surface 228. On a top surface 232 is a thin layer of fluid 234. Fluid can continuously flow over the top surface 232 of the partially segmented tapered acoustic horn 214 to create the thin layer of fluid 234, or fluid can be pooled on the top surface 232 of the partially segmented tapered acoustic horn 214. If the fluid continuously flows over the partially segmented tapered acoustic horn 214, the fluid may flow from a nearby opening, allowing a calculated amount of fluid to flow over the top surface 232 at any given time. By calculating and controlling the flow rate of the fluid, a height 236 of the thin layer of fluid 234 can be maintained. Furthermore, the thin layer of fluid 234 can take a variety of forms and dimensions. For example, the thin layer of fluid 234 (as well as fluid 112) can comprise catalyst particles and/or conductor particles. The thin layer of fluid 234 can also be void of particles. The dimensions of the thin layer of fluid 234 can vary, but the height 236 of the thin layer of fluid 234 is generally less than the spacing 226 between the acoustic horn extending elements 216. For example, the height 236 of the thin layer of fluid 234 may be approximately 1 mm when no sound waves are propagating through the partially segmented tapered acoustic horn 214. The unifying section 218 has a depth or width defined by upper surface 228 and top surface 232.

The sound waves generated from the piezoelectric elements 202 propagate through the fully segmented support structure 206 and cause vibrations in the partially segmented tapered acoustic horn 214. In one embodiment, the wavelength of the sound waves obtained in accordance with previously provided Equation 1.

The shape of the partially segmented tapered acoustic horn 214 focuses the sound waves to provide maximum transfer of energy to the thin layer of fluid 234. As the sound waves travel through the segmented tapered acoustic horn 214, the sound waves continue to travel primarily in areas of the partially segmented tapered acoustic horn 214 that are above the acoustic horn extending elements 216. The intensity of sound waves is greatest in areas of the areas of the unifying section 218 that are above acoustic horn extending elements 216.

The thin layer of fluid 234 on the top surface 232 of the partially segmented tapered acoustic horn 214 is disrupted from sound waves traveling through the segmented tapered acoustic horn 214. This causes capillary waves to form the thin layer of fluid 234. The capillary waves vary in intensity, and are most intense in areas of the thin layer of fluid 234 above the acoustic horn extending elements 216 of the segmented tapered acoustic horn 214. As the capillary waves reach sufficiently high amplitudes, the capillary waves begin to break apart and generate droplets 238.

Since the capillary waves are most intense in areas above the acoustic horn extending elements 216, the droplets 238 are ejected in areas of the thin layer of fluid 234 that are above the acoustic horn extending elements 216. This is due to sound waves being primarily directed by the segmented tapered acoustic horn 214 to areas of the thin layer of fluid 234 that are above the acoustic horn extending elements 216.

Figure 3:
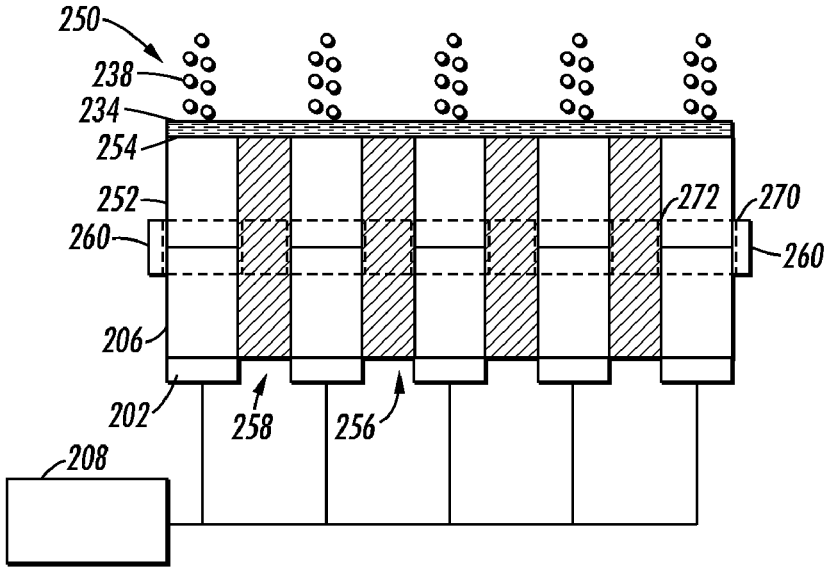
FIG. 3 is an apparatus for ejecting drops with a fully segmented acoustic horn.

Turning to FIG. 3, illustrated is a further embodiment of a drop-ejecting apparatus 250 according to the present application. For convenience of viewing numbering to components previously shown and described may not be shown in this Figure. This embodiment has a structure similar to that of previous embodiments, including FIG. 2, wherein the support structure is a fully segmented support structure 206. However, distinctions between this embodiment and the previous descriptions are that the acoustic horn is a fully segmented, tapered acoustic horn 252. In particular, unlike FIG. 2, there is no unifying section (e.g., unifying section 218 of FIG. 2). Rather, individual portions of the piezoelectric elements 202, fully segmented support structure 206, and in this embodiment, fully segmented tapered acoustic horn 252, are formed together as a standalone unit, distinct from other similarly constructed standalone units.

As can be seen in FIG. 3, the acoustic horn 252 is fully segmented up to a bottom surface 254 of thin layer of fluid 234. Therefore, the top surface 232 which was associated with the unifying section of the acoustic horn 214 of FIG. 2 does not exist, but rather surface 254 holding the thin layer of fluid 234 is illustrated.

The individual units (i.e., piezoelectric element 202, fully segmented support structure 206, and fully segmented acoustic horn 252) are arranged as in the previous embodiments. However, in this embodiment, filler material 256 is located between each of spaces 258. Thus, unlike the embodiments in FIGS. 1 and 2, where those drop ejectors included open areas 226, these previously open areas (now defined as areas 258) are filled with a material such as an epoxy or elastomer. These filler materials maintain the spacing between individually formed units of piezoelectric element 202, fully segmented support structure 206 and fully segmented acoustic horn 252. The materials selected may have a somewhat lower impedance than air, such as in space or area 226. However, there is the improved focus by extending the segmentation to surface 254 of the fluid layer 234.

Additionally, in some embodiments, the filler material 256 may have sufficient strength to hold the array in the formation desired. However, to add further support, in one embodiment, a bracket mechanism 260 is employed, which brackets the array of units (i.e., 202, 206 and 252), and filler material 256 in a compressed defined arrangement. As can be seen in FIG. 3, the bracket 260 holds the outer edges of the drop ejector 250, while the bracket extends (dotted line) across the array. In one embodiment of the device of FIG. 3, wavelength of sound waves is obtained in accordance with previously provided Equation 1.

In an additional embodiment, the bracket may be formed with extending prongs (such as identified as dotted line 270, 272) arranged to hold each individual standalone unit (again, i.e., 202, 206 and 252) in a rigid manner. In this design, the bracket would be sufficient to maintain the spacing between the units, and therefore the filler material 256 would not be needed.

Still further, the filler material 256 may be used in other ones of the embodiment, such as those described in FIGS. 1 and 2.

FIG. 4 illustrates a side view representative of the apparatuses of FIGS. 1, 2 and 3. Piezoelectric elements 104, 202 are in operative connection with the segmented metal support structure 106, 206. The tapered acoustic horn 108, 214 may or may not be segmented. Regardless, the tapered acoustic horn 108, 214 is shaped to gradually decrease in thickness from bottom to the top. For example, the width of the tapered acoustic horn 108, 214 is greatest at the point of contact with the segmented metal support structure 106, 206. The width of the tapered acoustic horn 108, 214 decreases to its minimum at the point where a thin layer of fluid 112, 234 rests.

Figure 5:
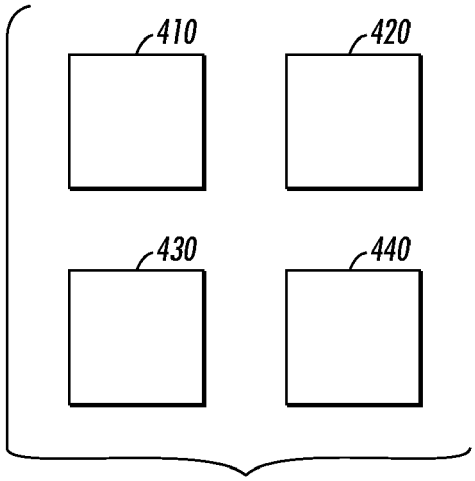
FIG. 5 depicts an example of deposits made by the subject apparatus on a surface.

FIG. 5 shows an example pattern 400 of deposits placed on a surface or substrate by the drop ejecting apparatus of the subject application. For simplicity, only four deposits—deposit 410, deposit 420, deposit 430 and deposit 440 are shown. To form the pattern 400, the following technique may be employed. Throughout the process, the material on which the deposits are to be formed is moved in a direction parallel to the surface of the tapered acoustic horn. A uniform high acoustic field is produced by the piezoelectric elements for a sufficient length of time to create deposit 410 and deposit 420. Next, the piezoelectric elements are de-energized for a length of time sufficient to create a desired space as the material is moved. Then the piezoelectric elements are turned on for another length of time to create deposit 430 and deposit 440. The timing of the turning on or off of the uniform high acoustic field depends of the pattern that the user desires to create.

Figure 6:
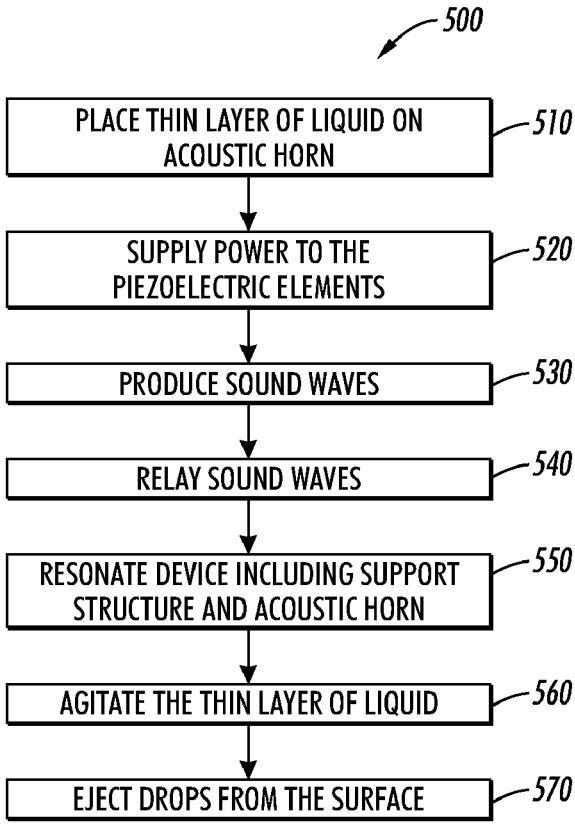
FIG. 6 details a method for depositing a thin layer of liquid on a surface in accordance with one exemplary embodiment of the subject application.

FIG. 6 represents a method in accordance with the claimed subject matter. At 510, a thin layer of liquid is placed on the top of an acoustic horn. Power is then supplied to piezoelectric elements at step 520. This results in the production of sound waves at 530. Sound energy is then relayed through the segmented metal support structure at 540. The device, including the support structure and the tapered acoustic horn begin to resonate at 550 due to the sound waves produced by the piezoelectric elements and transferred through the device. At 560, the sound waves agitate the thin layer of liquid on the top of the acoustic horn. The agitation of the fluid results in drops being ejected from the thin layer of fluid at 570.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. An apparatus for ejecting drops, the apparatus comprising:

a partially or fully segmented support structure comprising a first side and a second side with a plurality of extending elements;

piezoelectric elements in operative connection to at least some of the extending elements of the partially or fully segmented support structure on the first side; and an acoustic horn in operative connection to the second side of the partially or fully segmented support structure, a thickness of the acoustic horn decreases as distance increases from the second side of the partially or fully segmented support structure, the acoustic horn configured to resonate from energy emitted from the piezoelectric elements and transferred through the partially or fully segmented support structure.

2. The apparatus of claim 1, wherein the acoustic horn is partially segmented.

3. The apparatus of claim 1, wherein the acoustic horn is fully segmented.

4. The apparatus of claim 3, wherein a portion of the fully segmented support structure, a portion of the fully segmented acoustic horn and a piezoelectric element form a standalone unit, and a plurality of the standalone units are separated by filler material.

5. The apparatus according to claim 4, wherein the plurality of standalone units and filler material are held together by a clamping mechanism.

6. The apparatus of claim 1, wherein a thin layer of fluid disperses parallel to the vertical axis of the extending elements, upon the acoustic horn resonating from the energy emitted from the piezoelectric elements.

7. The apparatus of claim 1, wherein the wavelength of the energy produced by the piezoelectric elements is determined according to:

$$\frac{1}{2f} = \frac{L_1}{V_1} + \frac{L_2}{V_2} + \frac{L_3}{V_3},$$

where $L_1$ is the length of the acoustic horn, $L_2$ is the length of the partially or fully segmented support structure, $L_3$ is the length of the piezoelectric elements, $V_1$ is the speed at which sound travels through the material (i.e., its acoustic impedance) of the acoustic horn, $V_2$ is the speed at which sound travels through the material (i.e., its acoustic impedance) of the partially or fully segmented support structure and $V_3$ is the speed at which sound travels through the piezoelectric elements (i.e., its acoustic impedance) and/is frequency of the sound waves.

8. The apparatus of claim 6, wherein the thin layer of fluid comprises catalyst particles.

9. The apparatus of claim 1, further including a power source, wherein the power source can be controlled to produce a predetermined pattern.

10. A method for ejecting drops, the method comprising:

placing a thin layer of fluid above a top surface of an acoustic horn, the acoustic horn being attached to a fully or partially segmented support structure, the fully or partially segmented support structure comprising extending elements in operative connection to piezoelectric elements;

producing sound waves with the piezoelectric elements;

relaying the sound waves through the fully or partially segmented support structure;

resonating the acoustic horn with the sound waves; and ejecting droplets from the thin layer of fluid.

11. The method of claim 10, a portion of the fully segmented support structure, a portion of the fully segmented acoustic horn and a piezoelectric element form a standalone unit, and a plurality of the standalone units are separated by filler material.

12. The method of claim 10, wherein the acoustic horn is made of brass.

13. The method of claim 10, wherein the thin layer of fluid comprises conductor particles.

14. A system for depositing liquid on a substrate, the system comprising:

a fully or partially segmented support structure comprising a first side and a second side;

piezoelectric elements in operative connection to the first side of the fully or partially segmented support structure; and an acoustic horn in operative connection to the second side of the fully or partially segmented support structure, a thickness of the acoustic horn decreases as distance increases from the second side of the fully or partially segmented support structure, the acoustic horn configured to resonate from energy emitted from the piezoelectric elements and transferred through the fully or partially segmented support structure.

15. The system of claim 14, wherein the acoustic horn is partially segmented.

16. The system of claim 14, wherein the acoustic horn is fully segmented.

17. The system of claim 15, wherein the fully segmented support structure comprises independent elements.

18. The system of claim 14, a portion of the fully segmented support structure, a portion of the fully segmented acoustic horn and a piezoelectric element form a standalone unit, and a plurality of the standalone units are separated by filler material.

19. The system of claim 14, further comprising a thin layer of fluid above the top surface of the acoustic horn.

20. The system of claim 19, wherein the width of the thin layer of fluid is less than the spacing between the independent elements.

* * * * *